US006144812A

United States Patent [19]

Ueno

[11] Patent Number: 6,144,812

[45] **Date of Patent: *Nov. 7, 2000**

[54] IMAGE FORMATION SYSTEM HAVING A MEMORY DEVICE LOCATED IN AN ELECTROPHOTOGRAPHIC PROCESS CARTRIDGE FOR STORING DATA RELATING TO IMAGE FORMATION

[75] Inventor: Fumihiro Ueno, Mishima, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/268,708

[22] Filed: Mar. 16, 1999

[30] Foreign Application Priority Data

Mar. 20, 1998 [JP] Japan ..... 10-072890

[51] Int. Cl.[7] ..... G03G 15/00

[52] U.S. Cl. ..... 399/12; 399/9; 399/24

[58] Field of Search ..... 399/12, 13, 24, 399/25, 81, 9, 111, 119, 26

[56] References Cited

U.S. PATENT DOCUMENTS

| | | | |
|---|---|---|---|
| 4,912,512 | 3/1990 | Midorikawa et al. | 399/12 |
| 4,937,626 | 6/1990 | Kohtani et al. | 399/12 |
| 5,101,233 | 3/1992 | Ito et al. | 399/24 |
| 5,111,243 | 5/1992 | Hatano | 399/81 |
| 5,708,912 | 1/1998 | Lee | 399/24 |
| 5,835,817 | 11/1998 | Bullock et al. | 399/25 |
| 5,907,748 | 5/1999 | Kawana | 399/25 X |

FOREIGN PATENT DOCUMENTS

| | | |
|---|---|---|
| 4-299375 | 10/1992 | Japan . |
| 6-130754 | 5/1994 | Japan . |

*Primary Examiner*—Susan S. Y. Lee

[57] ABSTRACT

A memory is provided in an electrophotographic process cartridge to be mounted on a printer, and an area in the memory is separated into a read-only area and a rewritable area. In this structure, a data error in the memory is checked. If an error in the read-only area is detected, an alarm is displayed and a print operation is prohibited. On the other hand, if an error in the rewritable area is detected, the alarm is displayed and the print operation is permitted.

50 Claims, 9 Drawing Sheets

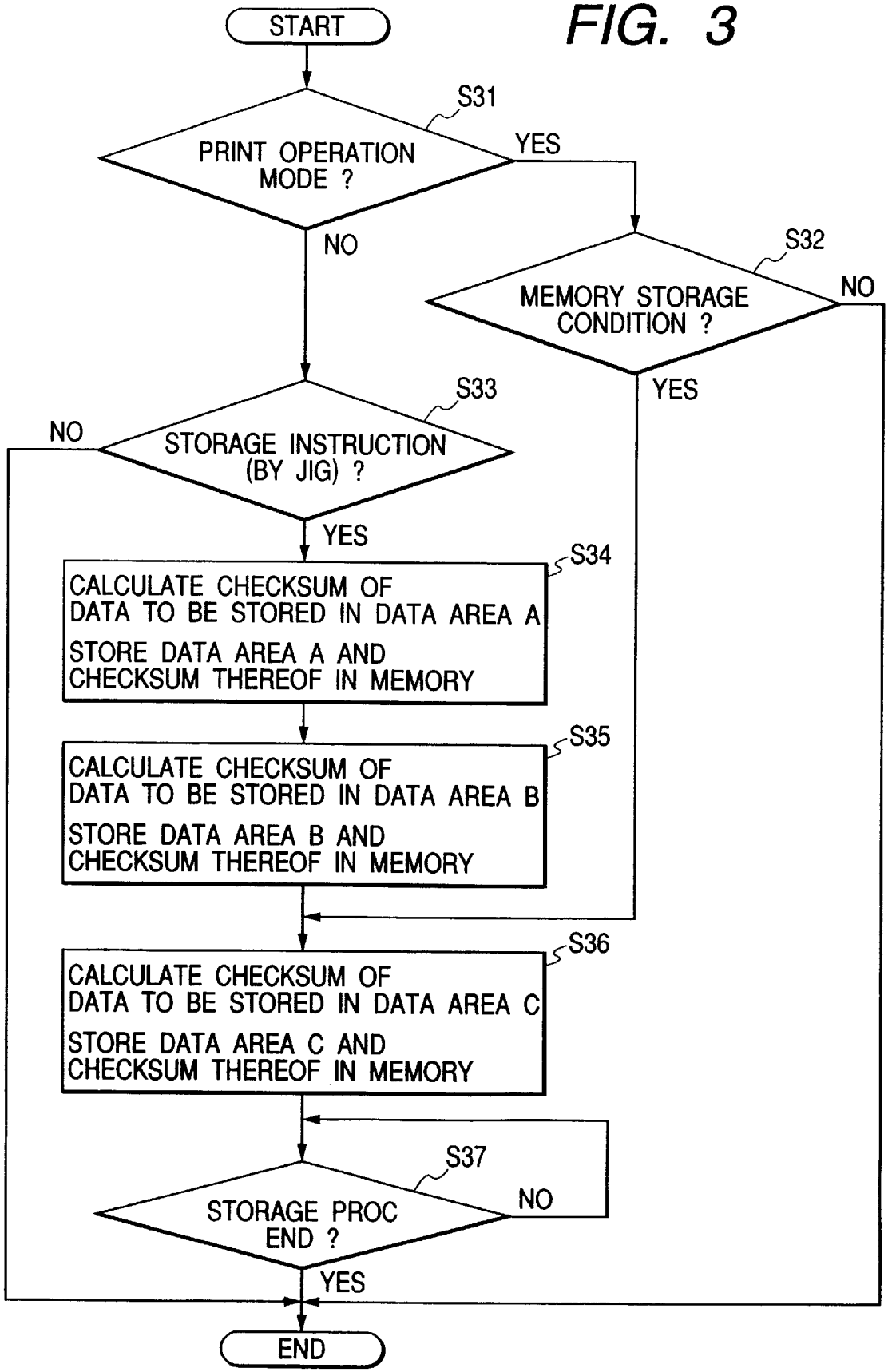
FIG. 3
START
S31
PRINT OPERATION MODE ?
YES
NO
S32
MEMORY STORAGE CONDITION ?
NO
YES
S33
STORAGE INSTRUCTION (BY JIG) ?
NO
YES
S34
CALCULATE CHECKSUM OF DATA TO BE STORED IN DATA AREA A
STORE DATA AREA A AND CHECKSUM THEREOF IN MEMORY
S35
CALCULATE CHECKSUM OF DATA TO BE STORED IN DATA AREA B
STORE DATA AREA B AND CHECKSUM THEREOF IN MEMORY
S36
CALCULATE CHECKSUM OF DATA TO BE STORED IN DATA AREA C
STORE DATA AREA C AND CHECKSUM THEREOF IN MEMORY
S37
STORAGE PROC END ?
NO
YES
END

IMAGE FORMATION SYSTEM HAVING A MEMORY DEVICE LOCATED IN AN ELECTROPHOTOGRAPHIC PROCESS CARTRIDGE FOR STORING DATA RELATING TO IMAGE FORMATION

BACKGROUND OF THE INVENTION

1. Field of the Invention

The present invention relates to an image formation apparatus for mounting a cartridge having a memory used in forming an image.

2. Related Background Art

In a printer of electrophotographic system described in Japanese Patent Application Laid-Open Nos. 4-299375, 6-130754 and the like, a nonvolatile memory is mounted on a cartridge in which a drum and a toner container are integrated. Data indicating a life of drum, the number of print sheets and the like is written into the nonvolatile memory. The life of drum and remaining quantity of a toner are detected by referring to the data. Although this data writing is performed by using plural sets of data, the set in which an error occurs is not used.

In the nonvolatile memory, not only the data used in detecting the life of drum and the remaining quantity of the toner but also data indicating a process condition suitable for the cartridge, identification information of the cartridge and the like are stored.

However, in a case where an error is detected upon performing an error detection operation to the nonvolatile memory according to a checksum or the like, it is desired to adequately judge whether or not an image formation operation is to be permitted.

SUMMARY OF THE INVENTION

An object of the present invention is to provide an image formation apparatus which takes the above-described problem into consideration.

Another object of the present invention is to provide a usable image formation apparatus in which an error process is made different according to an abnormality occurrence portion in a memory.

Other objects of the present invention will become apparent from the following description based on the attached drawings, and the appended claims.

BRIEF DESCRIPTION OF THE DRAWINGS

FIG. 3 is a flow chart showing a procedure of data writing process in the first embodiment;

DETAILED DESCRIPTION OF PREFERRED EMBODIMENTS

The embodiments of the present invention will be explained in detail with reference to the attached drawings.

(First Embodiment)

Figure 1:
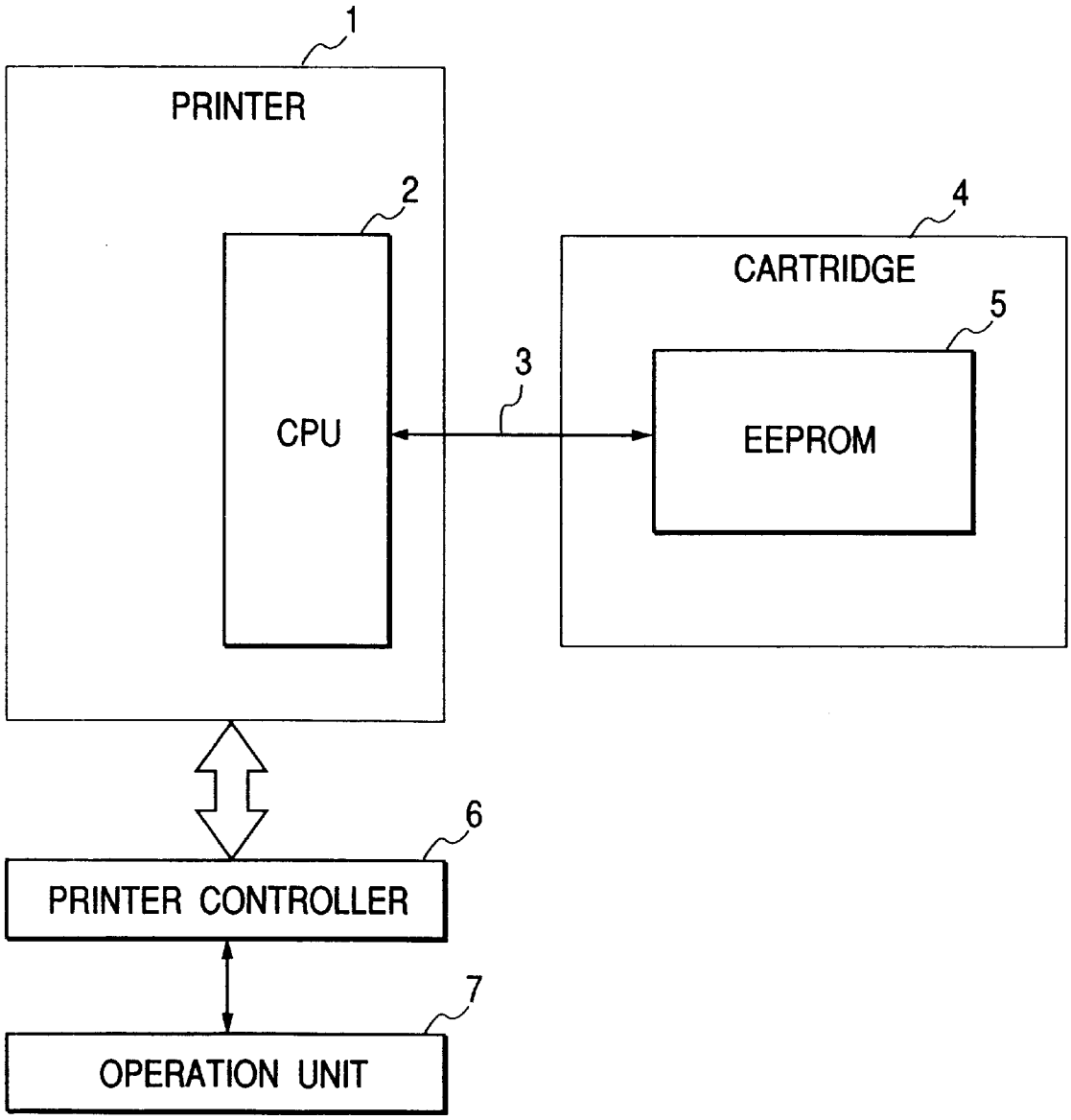
FIG. 1 is a block diagram for explaining a printer in a first embodiment of the present invention.

FIG. 1 is a block diagram showing the structure of an image formation apparatus in the first embodiment.

In FIG. 1, numeral 1 denotes a printer for forming an image based on an electrophotographic system. The printer 1 has such a structure as realizing the image formation in the electrophotographic system. That is, the printer 1 is composed of a laser drive circuit, a photosensitive drum, a toner supply unit, a charger, a developing unit, a fixing unit, a sheet (or paper) feed system and the like. In the present invention, the photosensitive drum and a toner container integrally constitute a cartridge 4 detachable in the printer 1. Numeral 2 denotes a CPU for controlling various operations such as an operation of the printer 1 and the like. The CPU 2 consists of a one-chip CPU involving a ROM (not shown), a RAM (not shown) and an I/O (not shown). Numeral 5 denotes a nonvolatile memory. In the present invention, e.g., an EEPROM (electrically erasable programmable read-only memory) is used as the nonvolatile memory. Numeral 6 denotes a printer controller, and numeral 7 denotes an operation unit. The CPU 2 controls the operation of the printer. The printer controller 6 controls transmission/reception of commands and print data to/from an external computer, and also controls transmission/reception of data to/from the operation unit.

The EEPROM 5 is involved in the cartridge 4. Thus, data used in managing conditions such as life of the photosensitive drum in the printer 1, the number of print sheets and the like is read/written from/into the EEPROM 5 under the control of the CPU 2. Numeral 3 denotes an interface line between the EEPROM 5 and the CPU 2 connected by a connector or the like in a case where the cartridge 4 is mounted in the printer 1.

The cartridge is not limited to the type that the photosensitive drum and the toner container are integrated. That is, the cartridge may be a type composed of only the photosensitive drum, a type composed of only the developing unit, or the like.

Figure 2:
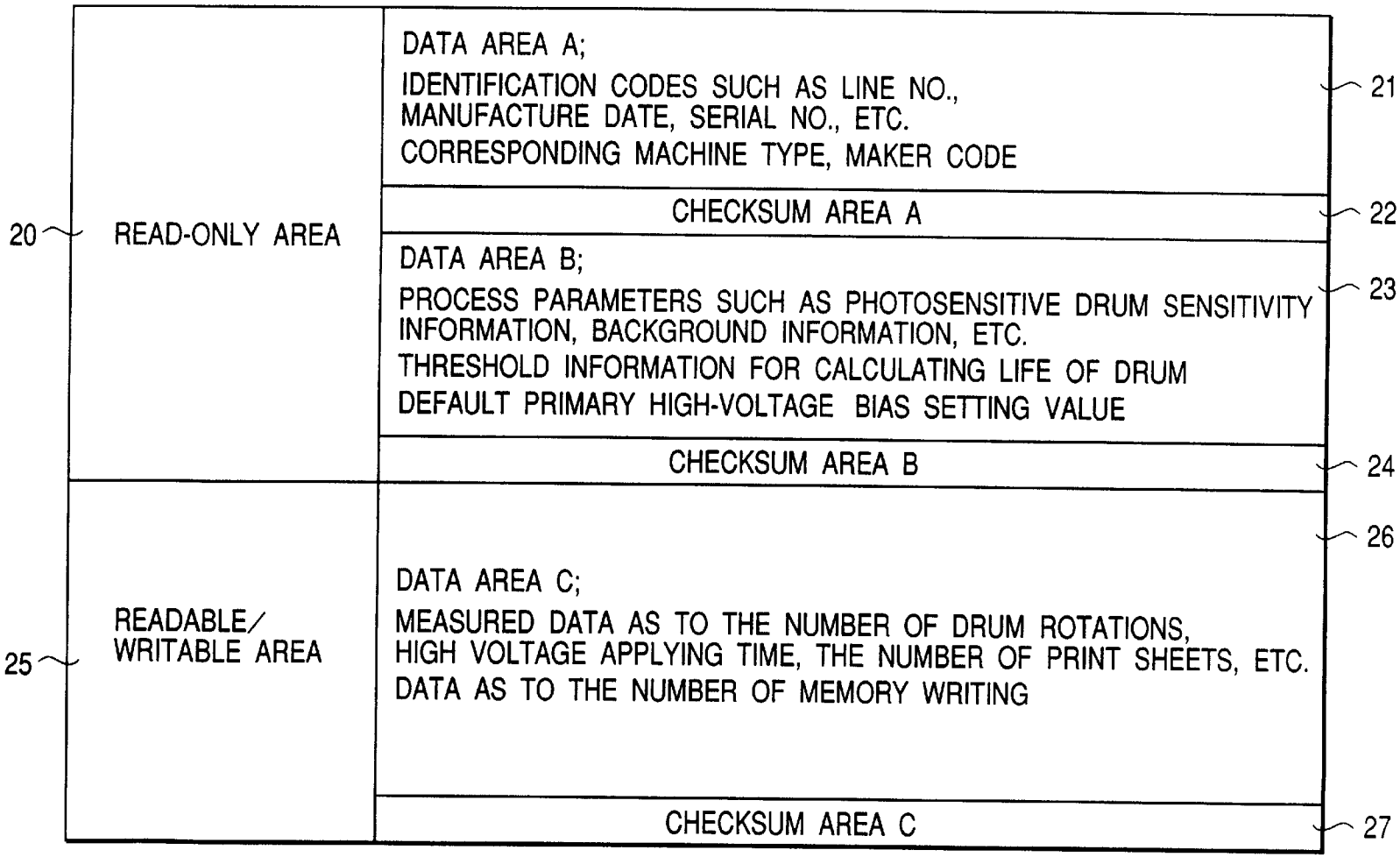
FIG. 2 is a view showing a structural example of areas in a memory in the first embodiment.

FIG. 2 shows a structural example of areas in the memory 5. As shown in FIG. 2, the areas in the memory 5 are classified into a read-only area 20 and a readable/writable area 25. According to importance of data, a data area and a checksum area thereof are reserved and utilized to check abnormality of data in the memory. That is, for example, the read-only area 20 is classified into a data area A21, a checksum area A22 of the data area A21, a data area B23 and a checksum area B24 of the data area B23. Furthermore, the readable/writable area 25 is classified into a data area C26 and a checksum area C27 of the data area C26.

In the data area A21, identification codes such as a manufacture line number, a manufacture date, a serial number and the like of the cartridge, a corresponding machine type and a maker code are stored. In the data area B23, process parameters concerning the photosensitive drum such as photosensitive drum sensitivity information, background information and the like, threshold information used in calculating the life of the drum and a default primary charge high-voltage bias setting value are stored. In the data area C26, the number of drum rotations used in calculating the life of the drum, a high voltage applying time, the number of print sheets and the number of memory writing used in observing the memory are stored.

In accordance with importance of the data, data writing timing is different. That is, the data writing into the data area A21 is performed only when the cartridge is assembled at a factory. The data writing into the area B23 is performed when the cartridge is assembled at the factory and delivered. The data writing into the data area C26 is performed every image formation of predetermined number of sheets when the cartridge is delivered, an OFF state of the image formation apparatus is detected, the drum is replaced, and the image formation apparatus is door opened. That is, parameter areas and data writing timing likely to give an unfavorable influence to image quality and the printer are classified so as to differ a process after error occurrence on the basis of possibility of data error.

A process of writing data into the memory 5 will be explained with reference to FIG. 3.

Initially, it is judged in a step S31 whether or not a print operation mode is being set. If the print operation mode is not set, the flow advances to a step S33 to judge whether or not a storage instruction is indicated. If the storage instruction is not indicated, the process terminates.

On the other hand, in the step S33, if the storage instruction by a specific jig is given from the input port, e.g., if one of the input ports at the CPU 2 is regarded as a trigger of the storage instruction and the instruction is given from this port, the flow advances to a step S34 and subsequent steps. In the steps S34, S35, S36 and S37, data in each of the data areas shown in FIG. 2 and a checksum value calculated from the data are stored in the memory 5. Then, if a storage operation terminates, the process terminates.

That is, in the step S34, a checksum of data to be stored in the data area A21 is calculated. The data to be stored in the data area A21 is stored in the area A21 and the calculated checksum A is stored in the checksum area A22.

Subsequently, in the step S34, a checksum of data to be stored in the data area B23 is calculated. The data to be stored in the data area B23 is stored in the area B23 and the calculated checksum B is stored in the checksum area B24.

Furthermore, in the step S36, a checksum of data to be stored in the data area C26 is calculated. The data to be stored in the data area C27 is stored in the area C27 and the calculated checksum C is stored in the checksum area C27.

On the other hand, if judged in the step S31 that the print operation mode is not set, the flow advances to a step S32 to judge a memory storage condition which has been previously determined. For example, it is judged whether or not the actual condition coincides with either one of the conditions "does a user intend to turn off a power switch in a state that a photosensitive drum cartridge is being mounted?", "is a door from which the photosensitive drum cartridge can be took opened?", and "does a print operation for the sheets of which number is equal to or larger than the predetermined number terminate?". If the actual condition coincides with either one of these conditions, the actual condition is considered as the memory storage condition. Of course, the memory storage condition is not limited to the above conditions, but various conditions may be set. In any case, if judged in the steps S32 that the actual condition is not the memory storage condition, the process terminates.

On the other hand, if judged in the step S32 that the above memory storage condition is satisfied, the process advances to the later-described step S36 to update the data in the readable/writable area 25.

Figure 4:
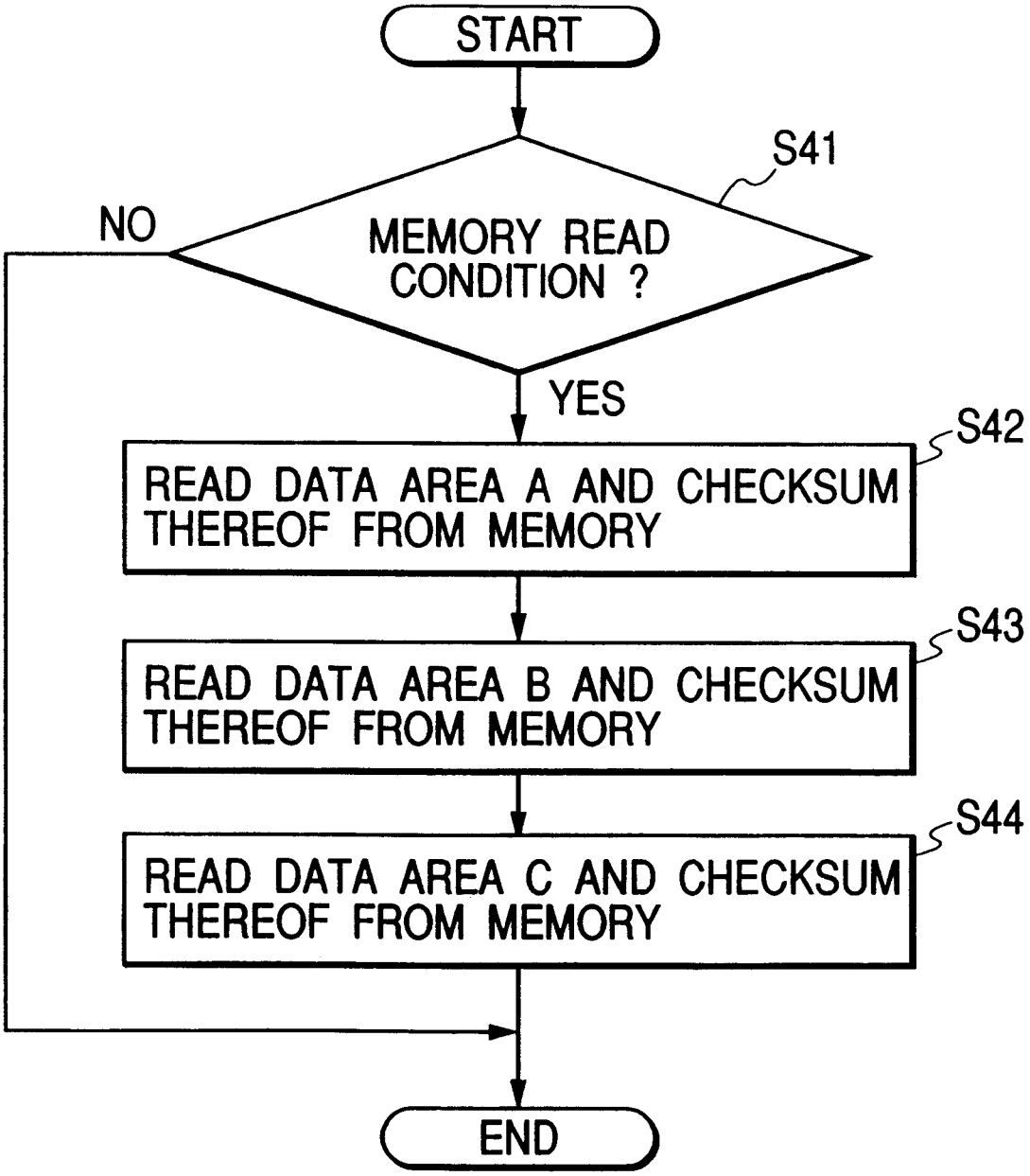
FIG. 4 is a flow chart showing a procedure of data reading process in the first embodiment.

Subsequently, the data reading from the memory 5 will be explained with reference to FIG. 4. Initially, it is judged in a step S41 whether or not a memory reading condition is satisfied. If judged that the memory reading condition is not satisfied, the process terminates.

On the other hand, if judged in the step S41 that the memory reading condition is satisfied, the flow advances to a step S42 and subsequent steps. In the steps S42, S43 and S44, the data areas in the memory 5 and checksum values concerning storage data stored in the data areas are read and then stored in a working memory (not shown).

That is, in the step S42, the data stored in the data area A21 and the checksum A stored in the checksum area A22 are read from the memory 5. Subsequently, in the step S43, the data stored in the data area B23 and the checksum B stored in the checksum area B24 are read from the memory 5. Furthermore, in the step S44, the data stored in the data area C26 and the checksum C stored in the checksum area C27 are read from the memory 5. The read data is temporarily stored in the not-shown working memory or the like. As the memory reading condition in the step S41, there are conditions "is an initial process is executed when the power is turned on by a power switch?" and "is the door from which the photosensitive drum cartridge can be took opened?". That is, if the actual condition coincides with either one of these conditions, the actual condition is considered as the memory reading condition.

Figure 5:
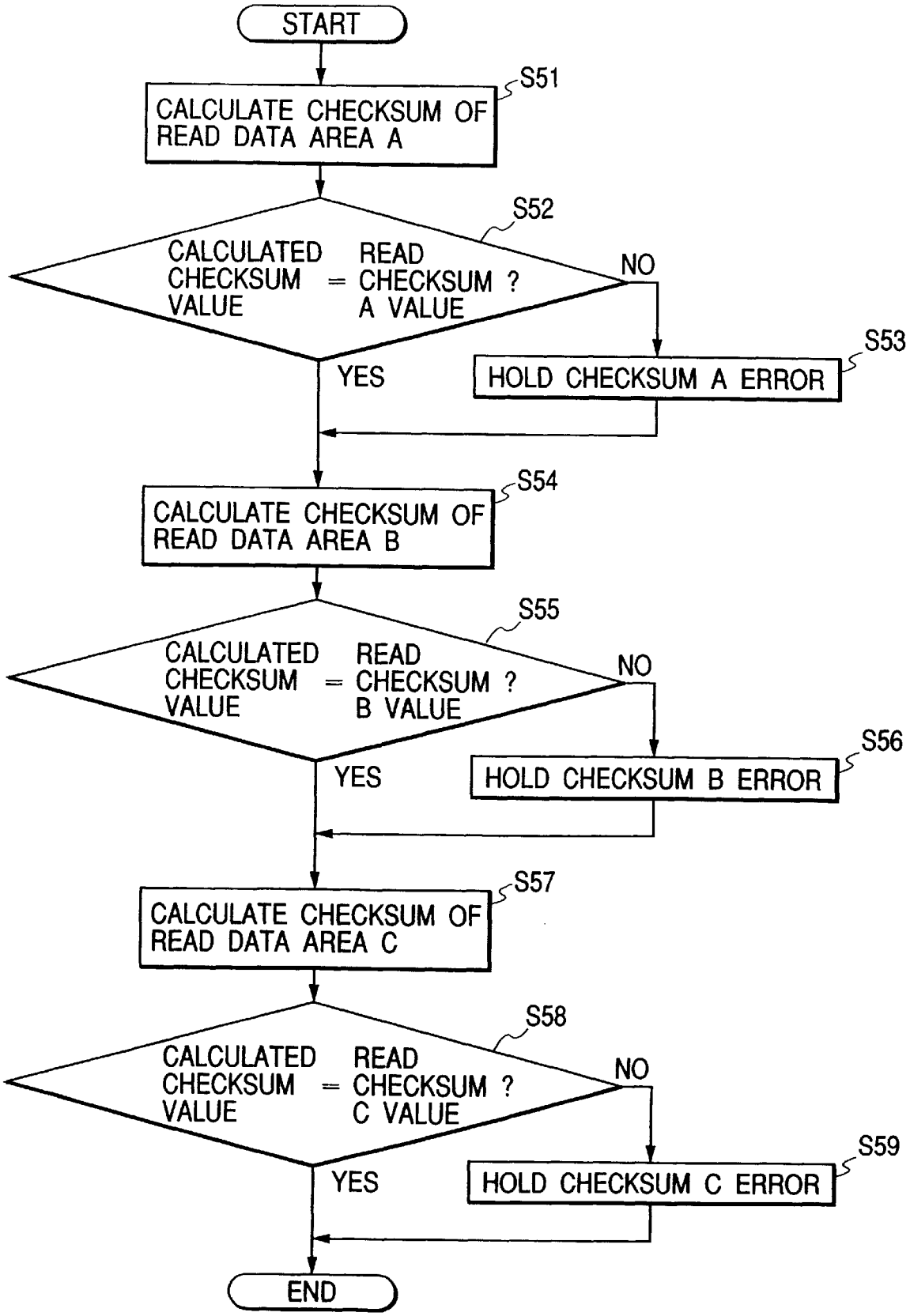
FIG. 5 is a flow chart showing a procedure of error check process in the first embodiment.

The operation to check the memory 5 will be explained with reference to FIG. 5. Initially, in a step S51, the checksum in the data area A21 is calculated. In a subsequent step S52, the calculated checksum value is compared with the value of the read checksum A to judge whether or not the both values are coincided with each other. If judged that these values are coincided with each other, the flow advances to a step S54.

On the other hand, if judged in the step S52 that these values are not coincided, a checksum A error is held. Then, the flow advances to the step S54.

In the step S54, the checksum in the data area B23 is calculated. In a subsequent step S55, the calculated checksum value is compared with the value of the read checksum B to judge whether or not the both values are coincided with each other. If judged that these values are coincided with each other, the flow advances to a step S57.

On the other hand, if judged in the step S55 that these values are not coincided, a checksum B error is held. Then, the flow advances to the step S57.

In the step S57, the checksum in the data area C26 is calculated. In a subsequent step S58, the calculated checksum value is compared with the value of the read checksum C to judge whether or not the both values are coincided with each other. If judged that these values are coincided with each other, the process terminates.

On the other hand, if judged in the step S58 that these values are not coincided, a checksum C error is held, and then the process terminates.

The above processes are executed subsequent to a data reading process.

Figure 6:
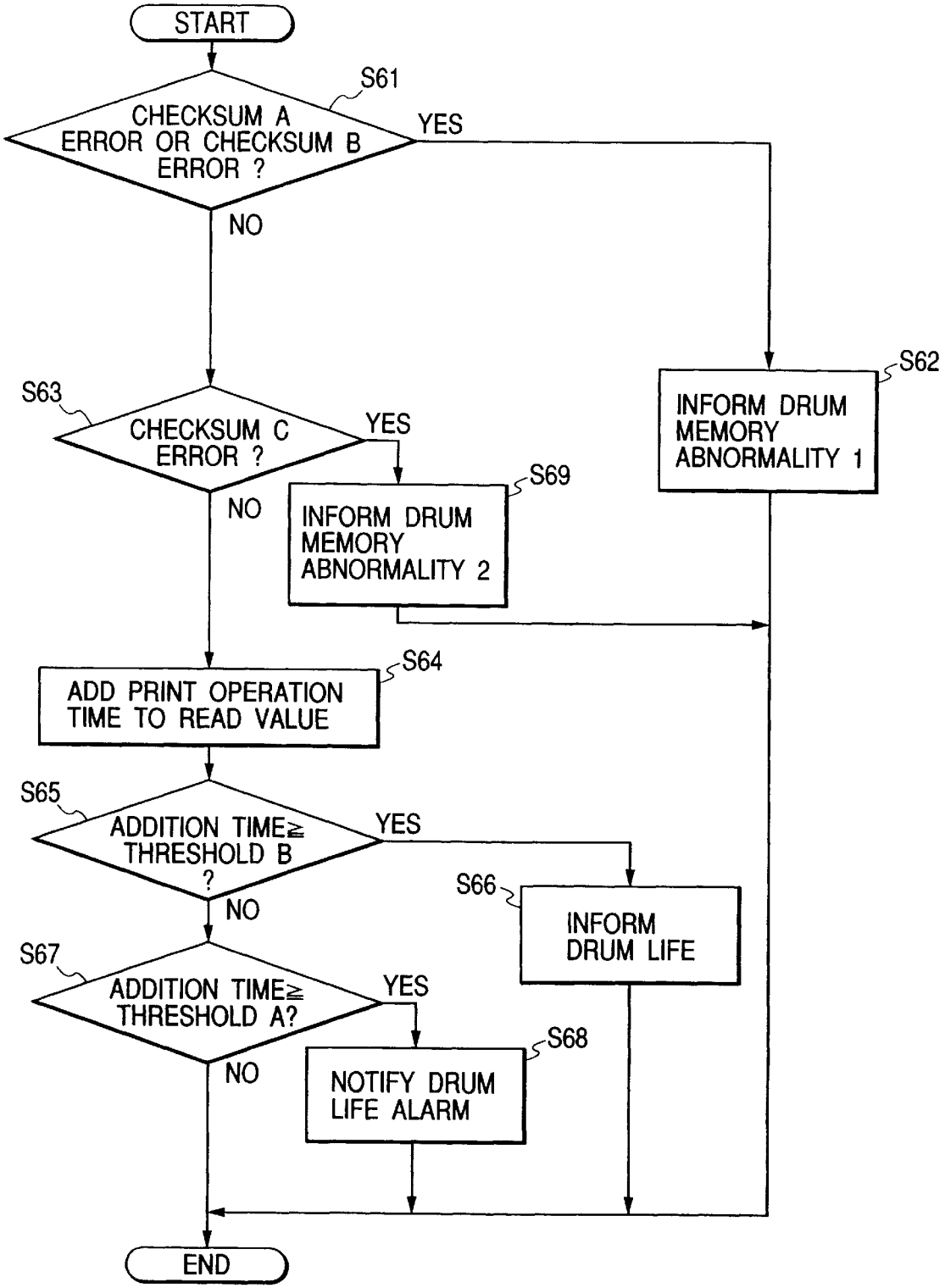
FIG. 6 is a flow chart showing a procedure of error process in the first embodiment.

Subsequently, the process to determine an error in the memory will be explained with reference to FIG. 6.

Initially, in a step S61, it is judged whether or not the error is the checksum error A or the checksum error B. That is, it is judged whether or not the error exists in the information of the read-only area 20 in the memory 5. If the error exists in the information of the read-only area 20, then the flow advances to a step S62 to inform the printer controller 6 about a photosensitive drum memory abnormality 1 upon judging that print quality can not be guaranteed. Thus, the printer controller 6 displays the error on the operation unit 7 as a operator call error and performs controlling to prohibit a print operation of the printer. Then, the process terminates.

On the other hand, in the step S61, if the error does not exist in the information of the read-only area 20 in the memory 5, the flow advances to a step S63 to judge whether or not the checksum C error exists. That is, it is judged whether or not the error exists in the readable/writable area 25 of the memory 5. If the error exists in the readable/writable area 25, the flow advances to a step S68 to inform the printer controller 6 about a photosensitive drum memory abnormality 2 upon judging selection as to whether or not the print is continued should depend on an operator. For example, the printer controller 6 considers that, if a warning is given, the print operation itself is possible. Thus, the controller 6 performs the control such that the alarm display is performed on the operation unit 7 and then the print operation is performed by the printer. After then, the process terminates.

On the other hand, in the step S63, if the error does not occur in the readable/writable area 25 in the memory 5, the flow advances to a step S64. In this step, print operation times such as a photosensitive drum rotation time, a high voltage applying time and the like are added to the value read from the memory 5 for judging the life of the drum. Then, in a subsequent step S65, the value added in the step S64 is compared with a threshold B. In this case, e.g., the threshold B indicates the value at which it becomes impossible to guarantee image quality. Then, if the value is equal to or larger than the threshold B, the flow advances to a step S66 from the step S65 to inform the printer controller 6 about life of the photosensitive drum. In the printer controller 6, the process for prohibiting the print operation of the printer or the like is executed upon displaying the error on the operation unit 7 as the operator call error.

On the other hand, in the step S65, if the addition value obtained in the step S64 is equal to or smaller than the threshold B, the flow advances to a step S67 from the step S65 to judge whether or not the addition value exceeds a threshold A. In this case, the threshold A is the value at which the alarm is given even though the life of the photosensitive drum does not terminate yet. If the addition value is equal to or smaller than the threshold A, since the photosensitive drum is in the satisfactory condition, the process terminates without informing any specific notification.

On the other hand, in the step S67, the addition value obtained in the step S64 is equal to or larger than the threshold A, the flow advances to a step S68 from the step S67 to inform the printer controller 6 about a photosensitive drum life alarm. In the controller 6, the condition that the life of the photosensitive drum terminates is displayed on the operation unit 7. In this case, the print operation of the printer is not prohibited.

The present invention is not limited to the above-described example, but may be applied to all members in cartridge system having detachable structures. For example, the present invention may be applied to a charger, a fixing unit, a discharger, a toner cartridge or the like.

For example, a memory is mounted on a cartridge (photosensitive drum, toner cartridge or the like) being a consuming part to store therein the information of the cartridge, and a sequence process is made different according to an extent of abnormality when information abnormality occurs in the memory. When the mounted memory is normal, it is possible to inform the printer controller 6 about consumption information of the consuming part in detail. On the other hand, when the memory is abnormal, it is possible to inform the controller 6 about an abnormality level, thereby improving image quality and usability.

When the memory is abnormal, the life of the photosensitive drum or the photosensitive drum life alarm is informed to a user and abnormality of the memory may be informed when a serviceman changes the operation mode to a maintenance mode.

That is, even if the memory abnormality is informed to the user, if the user does not cope with it, it is too meaningless to inform the user about the memory abnormality. Since image formation is prohibited because of any of abnormality of the read-only area in the memory and the life of the photosensitive drum, the life of the photosensitive drum is informed instead of the memory abnormality informing.

In a case where a writable area in the memory is abnormal, the photosensitive drum life alarm is informed.

By doing so, for example, in such a case as having the structure to inform the abnormality using a lamp such as an LED or the like, the number of display units can be decreased, thereby enabling to realize an effect of providing a low-priced apparatus.

(Second Embodiment)

Figure 7:
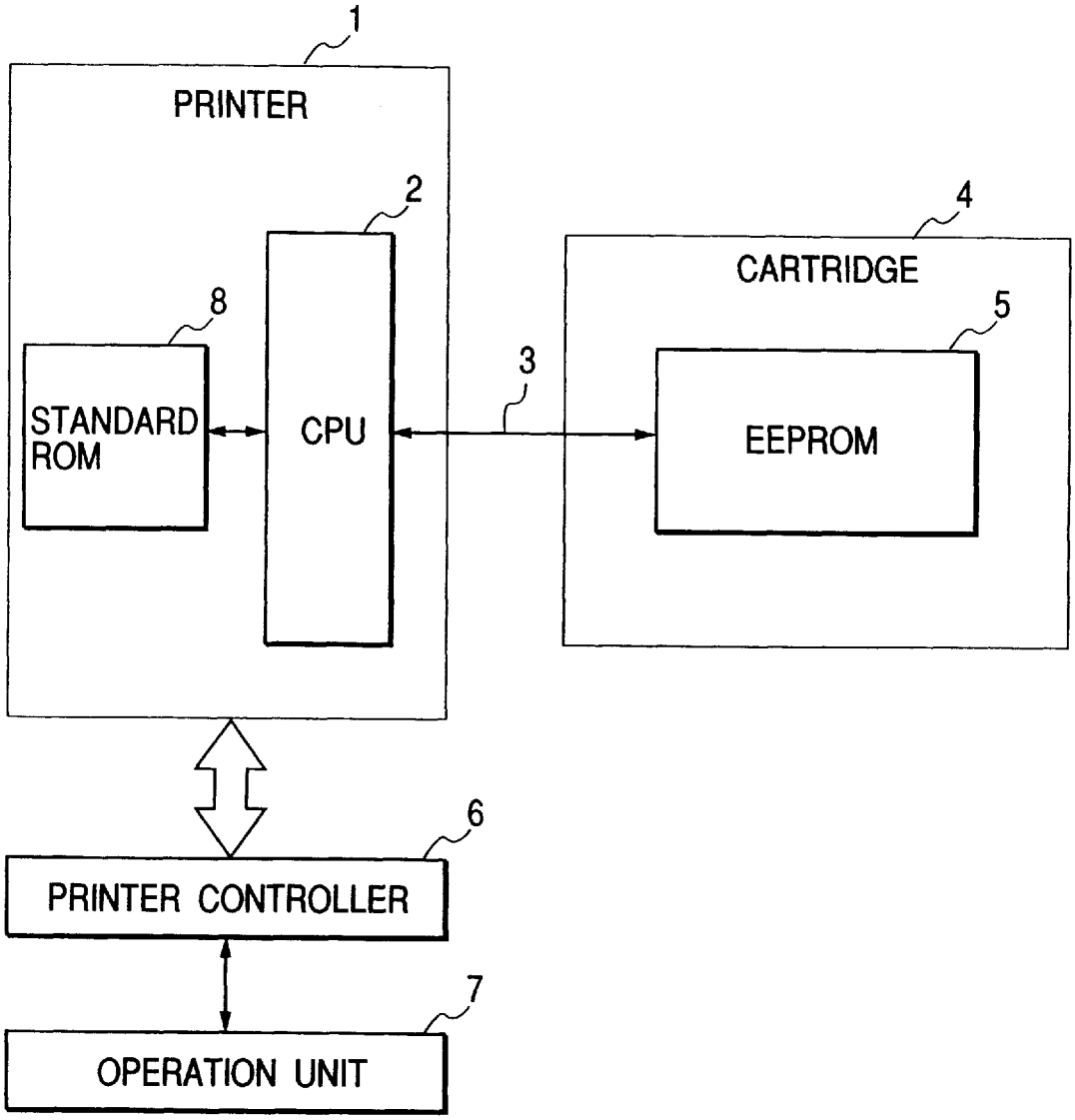
FIG. 7 is a block diagram for explaining a printer in a second embodiment of the present invention.

The second embodiment of the present invention will be explained hereinafter. FIG. 7 is a block diagram for explaining a printer control mechanism of an image formation apparatus in the second embodiment. The parts same as those in FIG. 1 are respectively added with the same reference numerals, and the detailed explanation thereof will be omitted. The second embodiment is different from the first embodiment in the point that a standard ROM 8 in which standard data has been previously registered for each cartridge is provided in a printer control unit 1. That is, other structures are the same as those in FIG. 1.

In the processes of the second embodiment, an error process is different from that in the first embodiment. That is, other processes in the present embodiment are the same as those in the first embodiment. Hereinafter, the process different from that in the first embodiment will be explained.

In the first embodiment, if the error occurs in the information of the read-only area 20 in the memory 5, or if the certain value exceeds the threshold B indicating the life of the photosensitive drum, it is judged that it is impossible to guarantee the image quality. Thus, such the situation is informed to the printer controller 6, whereby the controller 6 makes the print operation impossible based on its own judgment.

However, even if the image quality is not optimum, it is expected that the printing of a few more sheets is required. In this case, since the apparatus stops the operation, it can not be used at all in the first embodiment. This situation is likely to cause remarkable deterioration in usability for a user.

In the second embodiment, even if it is judged that the image quality can not be guaranteed, the image formation apparatus does not stop the operation. Instead, such the situation is informed to a printer controller 6 as a warning, and the printer controller 6 performs a control depending on a user's instruction.

Figure 8:
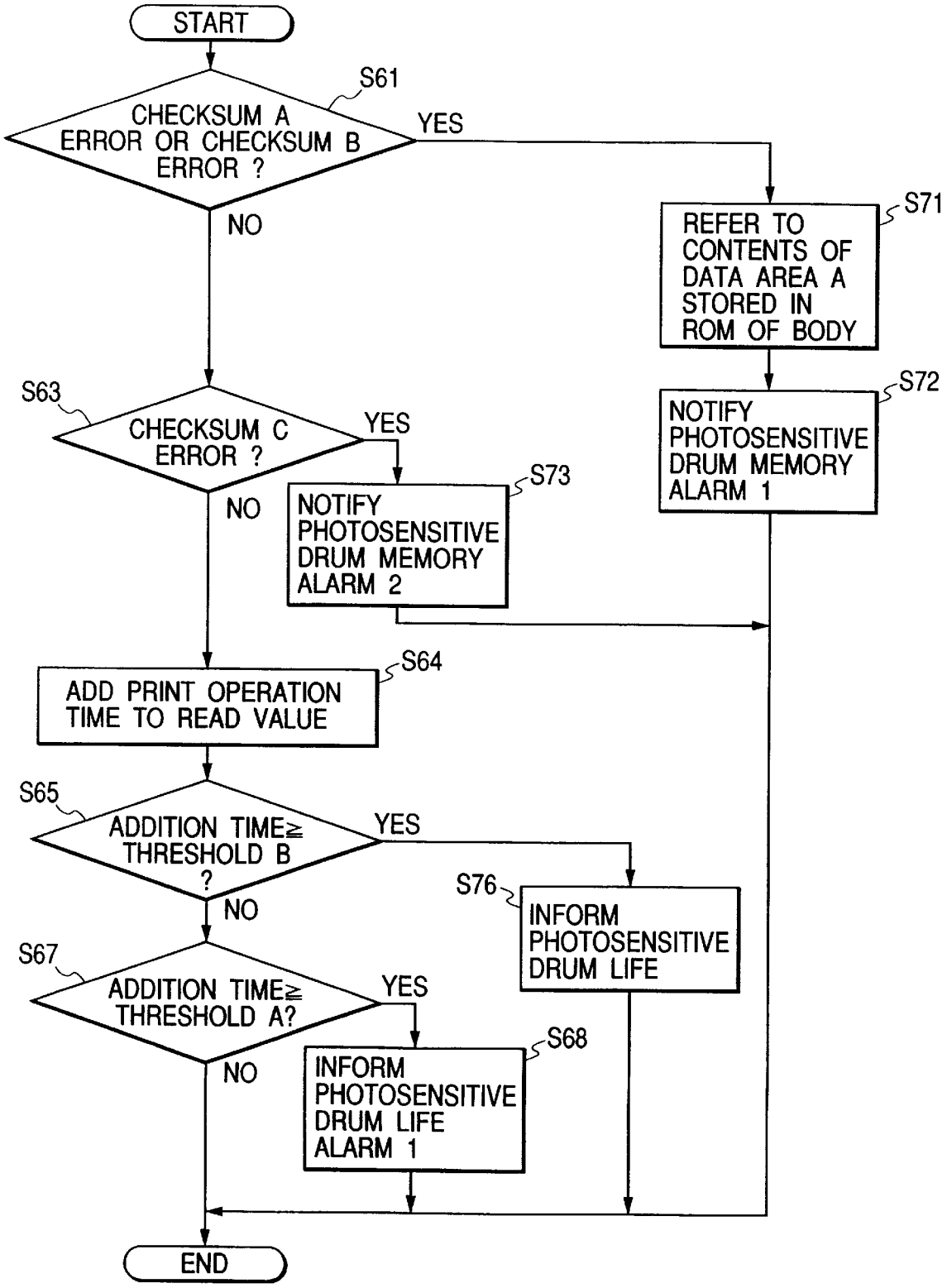
FIG. 8 is a flow chart showing a procedure of error process in the second embodiment.

The error process in the second embodiment will be explained with reference to FIG. 8. In FIG. 8, the steps of which processes are the same as those in FIG. 6 are respectively added with the same reference numerals, and the detailed explanation thereof will be omitted.

In a step S61, if a checksum A error or a checksum B error exists, and if an error exists in information of a read-only area in a memory 5, the flow advances to a step S71. In the step S71, the standard data which has been previously stored in the standard ROM 8 in the printer control unit 1 (i.e., not in cartridge) and is corresponding to data A stored in a data area A21 in the memory 5 is read to be treated as reference data.

In a subsequent step S72, the memory 5 in the cartridge is read, and a photosensitive drum memory alarm 1 is informed to the printer controller 6. In this step, the alarm 1 indicates a wrong state of reading data from the read-only area 20. The printer controller 6 only displays this alarm on an operation unit 7. That is, the controller 6 permits a print operation of a printer. Then, the process terminates.

On the other hand, in a step S63, if a checksum C error exists, i.e., if the error exists in a readable/writable area 25 in the memory 5, then the flow advances to a step S73. In the step S73, a photosensitive drum memory alarm 2 is informed to the printer controller 6. In this step, the alarm 2 indicates a wrong state of reading and writing data from or into the readable/writable area 25 in the memory 5 of the cartridge. The printer controller 6 only displays this alarm on the operation unit 7. That is, the controller 6 permits the print operation of the printer. Then, the process terminates.

Furthermore, in a step S65, if a value added in a step S64 is equal to or larger than a threshold B, the flow advances to a step S76 to inform the printer controller 6 about a photosensitive drum life B which indicates life of a photosensitive drum. The printer controller 6 only displays this life on the operation unit 7. That is, the controller 6 permits the print operation of the printer. Then, the process terminates.

Furthermore, in a step S67, if the value added in the step S64 is equal to or larger than a threshold A, the flow advances to a step S68 to inform the controller 6 about a photosensitive drum life alarm. The printer controller 6 displays the photosensitive drum life alarm on the operation unit 7. Even in this case, the print operation of the printer is not prohibited. As already explained in the first embodiment, even if the memory is abnormal, the life of the photosensitive drum or the photosensitive drum life alarm may be informed to the user.

Figure 9:
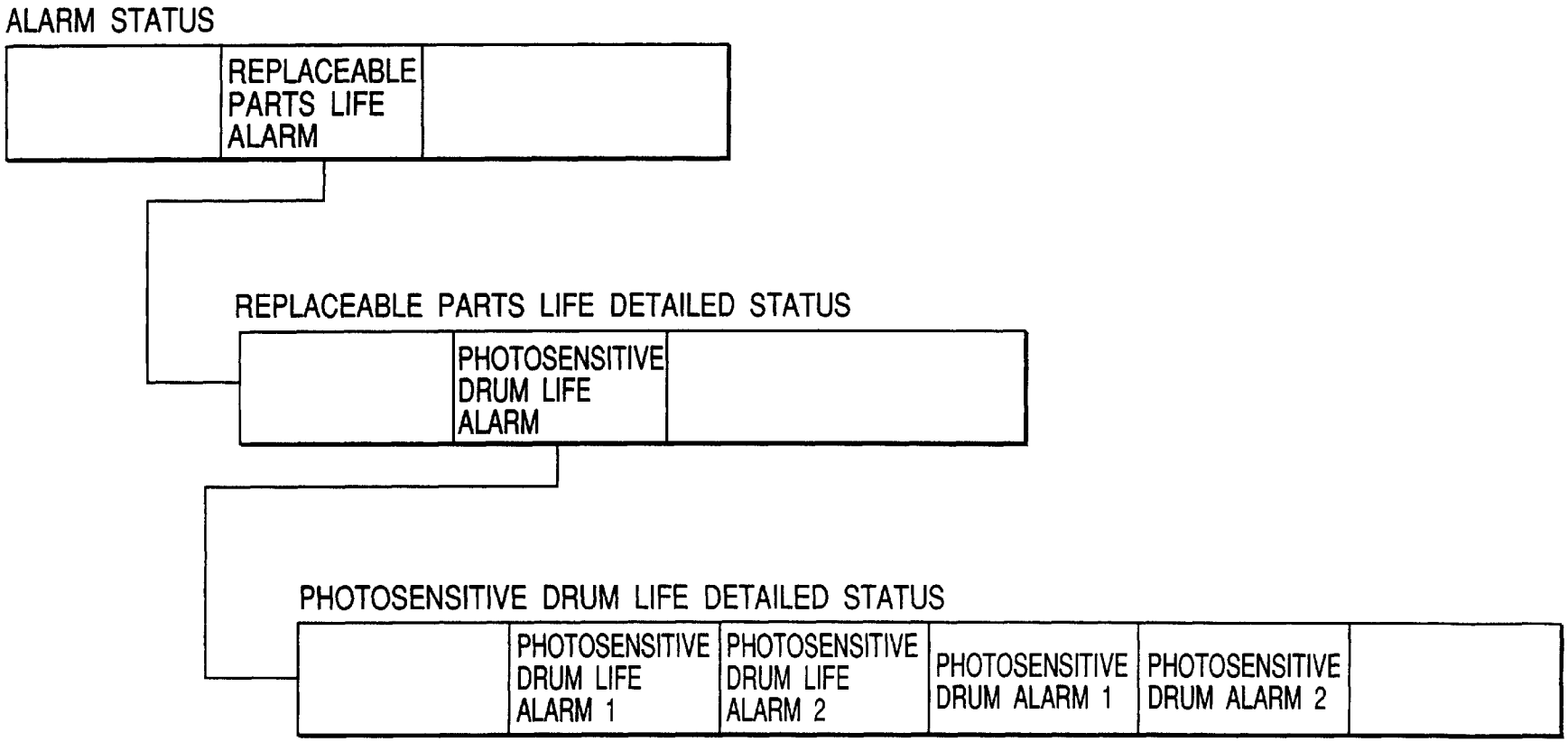
FIG. 9 is a view showing hierarchical notification information in the second embodiment.

As above, in the case where the life of the cartridge member such as the photosensitive drum or the like exceeds a life threshold, or in the case where a photosensitive drum memory is abnormal, merely a life alarm is informed, but it is possible to perform the print operation itself. Accordingly, the selection as to whether or not the print operation is to be performed depends on the user's instruction. Furthermore, as shown in FIG. 9, the detail of the alarm, i.e., a level at which the image quality is not guaranteed may be hierarchically informed such that the user can sufficiently recognize the condition of the apparatus.

The present invention can be applied, in addition to the printer, to a system consisting of plural devices (e.g., host computer, interface equipment, reader, printer and the like), or to an apparatus comprising a single device (e.g., copy machine, facsimile apparatus or the like).

Furthermore, the present invention can be applied to a case where a storage medium storing therein program codes of software to realize the functions of the above embodiments is supplied to a system or an apparatus, and thus a computer (or CPU, MPU) in the system or apparatus reads and executes the program codes stored in the medium.

In this case, the program codes themselves read out of the storage medium realize the functions of the above embodiments. Therefore, the storage medium storing these program codes constitutes the present invention.

As the storage medium from which the program codes are supplied, e.g., a floppy disk, a hard disk, an optical disk, a magneto-optical disk, a CD-ROM, a CD-R, a magnetic tape, a non-volatile memory card, a ROM and the like can be used.

Further, it can be obviously understood that the present invention includes not only a case where the functions of the above embodiments are realized by executing the program codes read by the computer, but also a case where an OS (operating system) or the like running on the computer performs a part or all of the actual processes on the basis of instructions of the program codes and thus the functions of the above embodiments are realized by such the processes.

Furthermore, it can be obviously understood that the present invention also includes a case where, after the program codes read out of the storage medium are written into a function expansion board inserted in the computer or a memory in a function expansion unit connected to the computer, a CPU or the like provided in the function expansion board or the function expansion unit performs a part or all of the actual processes on the basis of the instructions of the program codes, and thus the functions of the above embodiments are realized by such the processes.

In the case where the present invention is applied to the above storage medium, the program codes corresponding to the above-explained flow charts are stored in the storage medium.

The present invention is not limited to the above embodiments, but many apparently widely different embodiments of the present invention can be made without departing from the spirit and scope of the appended claims.

What is claimed is:

1. An image formation apparatus capable of mounting a cartridge having a memory used in forming an image, comprising:

readout means for reading data stored in a first area and a second area in the memory in a state that the cartridge is being mounted;

judgment means for judging the first area data and the second area data in the memory to be read by said readout means; and control means for giving an alarm and prohibiting image formation when abnormality of the first area data is detected by said judgment means, and giving the alarm and permitting the image formation when abnormality of the second area data is detected by said judgment means.

2. An apparatus according to claim 1, wherein the first area is a read-only area and the second area is a rewritable area.

3. An apparatus according to claim 2, wherein the first area data includes data determined for each cartridge.

4. An apparatus according to claim 3, wherein the data determined for each cartridge is the data stored when the cartridges are delivered or assembled.

5. An apparatus according to claim 4, wherein the data determined for each cartridge includes identification data of the cartridge.

6. An apparatus according to claim 4, wherein the data determined for each cartridge includes data representing a characteristic of the cartridge.

7. An apparatus according to claim 1, wherein said judgment means detects the abnormality according to a checksum of the stored data.

8. An apparatus according to claim 2, wherein the second area data includes data proportional to accumulated use quantity of the cartridge.

9. An apparatus according to claim 1, wherein said readout means reads the data in the memory when said image formation apparatus is ON or a door of said image formation apparatus is closed because of replacing the cartridge.

10. An image formation apparatus capable of mounting a cartridge having a memory used in forming an image, comprising:

readout means for reading data stored in a first area and a second area in the memory in a state that the cartridge is being mounted;

judgment means for judging first kind of data and second kind of data in the memory to be read by said readout means; and control means for giving an alarm and prohibiting image formation when abnormality of the first kind of data is detected by said judgment means, and giving the alarm and permitting the image formation when abnormality of the second kind of data is detected by said judgment means.

11. An apparatus according to claim 10, wherein the first kind of data includes data determined for each cartridge and the second kind of data includes data changing in accordance with use of the cartridge.

12. An apparatus according to claim 11, wherein the data determined for each cartridge is the data to be stored when the cartridges are delivered or assembled.

13. An apparatus according to claim 11, wherein the data determined for each cartridge includes identification data of the cartridge.

14. An apparatus according to claim 11, wherein the data determined for each cartridge includes data representing a characteristic of the cartridge.

15. An apparatus according to claim 10, wherein said judgment means detects the abnormality according to a checksum of the stored data.

16. An apparatus according to claim 11, wherein the second kind of data includes data proportional to accumulated use quantity of the cartridge.

17. A control method of an image formation apparatus capable of mounting a cartridge having a memory used in forming an image, comprising the steps of:

(a) reading data stored in a first area and a second area in the memory in a state that the cartridge is being mounted;

(b) judging the first area data and the second area data in the memory to be read in said step (a); and (c) giving an alarm and prohibiting image formation when abnormality of the first area data is detected in said step (b), and giving the alarm and permitting the image formation when abnormality of the second area data is detected in said step (b).

18. A method according to claim 17, wherein the first area is a read-only area and the second area is a rewritable area.

19. A method according to claim 18, wherein the first area data includes data determined for each cartridge.

20. A method according to claim 19, wherein the data determined for each cartridge is the data stored when the cartridges are delivered or assembled.

21. A method according to claim 20, wherein the data determined for each cartridge includes identification data of the cartridge.

22. A method according to claim 20, wherein the data determined for each cartridge includes data representing a characteristic of the cartridge.

23. A method according to claim 17, wherein said step (b) detects the abnormality according to a checksum of the stored data.

24. A method according to claim 18, wherein the second area data includes data proportional to accumulated use quantity of the cartridge.

25. A method according to claim 17, wherein said step (a) reads the data in the memory when the image formation apparatus is ON or a door of the image formation apparatus is closed because of replacing the cartridge.

26. A control method of an image formation apparatus capable of mounting a cartridge having a memory used in forming an image, comprising the steps of:

(a) reading data stored in a first area and a second area in the memory in a state that the cartridge is being mounted;

(b) judging first kind of data and second kind of data in the memory to be read in said step (a); and (c) giving an alarm and prohibiting image formation when abnormality of the first kind of data is detected in said step (b), and giving the alarm and permitting the image formation when abnormality of the second kind of data is detected in said step (b).

27. A method according to claim 26, wherein the first kind of data includes data determined for each cartridge and the second kind of data includes data changing in accordance with use of the cartridge.

28. A method according to claim 27, wherein the data determined for each cartridge is stored when the cartridges are delivered or assembled.

29. A method according to claim 27, wherein the data determined for each cartridge includes identification data of the cartridge.

30. A method according to claim 27, wherein the data determined for each cartridge includes data representing a characteristic of the cartridge.

31. A method according to claim 26, wherein said step (b) detects the abnormality according to a checksum of the stored data.

32. A method according to claim 27, wherein the second kind of data includes data proportional to accumulated use quantity of the cartridge.

33. An image formation apparatus capable of mounting a cartridge having a memory used in forming an image, comprising:

readout means for reading data stored in a first area, which is read-only area, and a second area, which is a rewritable area, in the memory in a state that the cartridge is being mounted;

judgment means for judging the first area data and the second area data in the memory to be read by said readout means; and control means for performing first abnormality processing when abnormality of the first area data is detected by said judgment means, and performing second abnormality processing different from the first abnormality processing when abnormality of the second area data is detected by said judgment means.

34. An apparatus according to claim 33, wherein the second area data includes data which changes according to specifics of the cartridge.

35. An apparatus according to claim 33, wherein the first area data includes data determined for each cartridge.

36. An apparatus according to claim 35, wherein the data determined for each cartridge is the data stored when the cartridges are delivered or assembled.

37. An apparatus according to claim 35, wherein the data determined for each cartridge includes identification data of the cartridge.

38. An apparatus according to claim 36, wherein the data determined for each cartridge includes data representing a characteristic of the cartridge.

39. An apparatus according to claim 33, wherein said judgment means detects the abnormality according to a checksum of the stored data.

40. An apparatus according to claim 33, wherein the second area data includes data proportional to accumulated use quantity of the cartridge.

41. An apparatus according to claim 33, wherein said readout means reads the data in the memory when said image formation apparatus is ON or a door of said image formation apparatus is closed because of replacing the cartridge.

42. A control method of an image formation apparatus capable of mounting a cartridge having a memory used in forming an image, comprising the steps of:

(a) reading data stored in a first area, which is a read-only area, and a second area, which is a rewritable area, in the memory in a state that the cartridge is being mounted;

(b) judging the first area data and the second area data in the memory to be read in said step (a); and (c) performing first abnormality processing when abnormality of the first area data is detected in said step (b), and performing second abnormality processing different from the first abnormality processing when abnormality of the second area data is detected in said step (b).

43. A method according to claim 42, wherein the second area data includes data which changes according to specifics of the cartridge.

44. A method according to claim 42, wherein the first area data includes data determined for each cartridge.

45. A method according to claim 42, wherein the data determined for each cartridge is the data stored when the cartridges are delivered or assembled.

46. A method according to claim 45, wherein the data determined for each cartridge includes identification data of the cartridge.

47. A method according to claim 45, wherein the data determined for each cartridge includes data representing a characteristic of the cartridge.

48. A method according to claim 42, wherein said step (b) detects the abnormality according to a checksum of the stored data.

49. A method according to claim 42, wherein the second area data includes data proportional to accumulated use quantity of the cartridge.

50. A method according to claim 42, wherein said step (a) reads the data in the memory when the image formation apparatus is ON or a door of the image formation apparatus is closed because of replacing the cartridge.

* * * * *

UNITED STATES PATENT AND TRADEMARK OFFICE

CERTIFICATE OF CORRECTION

PATENT NO. : 6,144,812
DATED : November 7, 2000
INVENTOR(S) : Fumihiro Ueno

It is certified that error appears in the above-identified patent and that said Letters Patent is hereby corrected as shown below:

Title page,
Item [56] References Cited, Foreign Patent Documents, the following should be inserted:
-- Attorney, Agent or Firm -- Fitzpatrick, Cella, Harper & Scinto --.

Column 3,
Line 48, "took" should be deleted.

Column 4,
Line 15, "is" (second occurrence) should be deleted; and
Line 17, "took" should be deleted.

Column 5,
Line 11, "then," should read -- that, --.

Column 6,
Lines 36 and 48, "the" (second occurrence) should read -- a --;
Line 54, "which" should read -- whichever --; and
Line 57, "a" (first occurrence) should read -- the --.

Column 8,
Line 4 and 13, "such the" should read -- such --.

Column 12,
Line 1, "claim 42," should read -- claim 44, --.

Signed and Sealed this

Thirteenth day of November, 2001

*Attest:*

Nicholas P. Godici

NICHOLAS P. GODICI
*Acting Director of the United States Patent and Trademark Office*

*Attesting Officer*